US010226788B2

(12) United States Patent
Yamada et al.

(10) Patent No.: US 10,226,788 B2
(45) Date of Patent: Mar. 12, 2019

(54) ATTACHMENT COATING METHOD

(71) Applicants: OLYMPUS CORPORATION, Tokyo (JP); YOSHIDA INDUSTRY CO., LTD., Sabae-shi, Fukui-ken (JP)

(72) Inventors: Masashi Yamada, Sagamihara (JP); Hideaki Katsumi, Echizen (JP)

(73) Assignees: OLYMPUS CORPORATION, Tokyo (JP); YOSHIDA INDUSTRY CO., LTD., Sabae-shi (JP)

( * ) Notice: Subject to any disclaimer, the term of this patent is extended or adjusted under 35 U.S.C. 154(b) by 0 days.

(21) Appl. No.: 14/962,630

(22) Filed: Dec. 8, 2015

(65) Prior Publication Data

US 2016/0167084 A1 Jun. 16, 2016

(30) Foreign Application Priority Data

Dec. 15, 2014 (JP) ..... 2014-252915

(51) Int. Cl.
*B05D 1/18* (2006.01)
*C23C 24/02* (2006.01)
*B06B 1/06* (2006.01)

(52) U.S. Cl.
CPC ..... *B05D 1/18* (2013.01); *C23C 24/02* (2013.01); *B05D 2202/00* (2013.01)

(58) Field of Classification Search
CPC ... C23C 24/02; C23C 24/045; C23C 18/1287; C23C 18/1666; C25D 5/20; C03C 2218/117; B05D 1/18; B05D 2202/00
USPC ..... 427/601
See application file for complete search history.

(56) References Cited

U.S. PATENT DOCUMENTS 2,907,674 A * 10/1959 Metcalfe ..... C25D 13/00 101/DIG. 37
2,979,417 A * 4/1961 Kruger ..... G04B 1/145 116/168
3,140,859 A * 7/1964 Scarpa ..... B06B 1/0618 310/323.18
3,297,470 A * 1/1967 Martel ..... C03C 25/42 264/DIG. 19
3,481,839 A * 12/1969 Inoue ..... C25D 13/00 205/106

(Continued)

FOREIGN PATENT DOCUMENTS

JP H01-111899 A 4/1989
JP 2001-151828 A 6/2001
JP 2012-516362 A 7/2012

OTHER PUBLICATIONS

F.M. Ernsberger; "Mechanism of Frictional Electrification of Dielectric Liquids"; Journal of Applied Physics, vol. 27; pp. 418-419; 1956 (no month).*

(Continued)

*Primary Examiner* — Marianne L Padgett
(74) *Attorney, Agent, or Firm* — Oliff PLC

(57) ABSTRACT

An attachment coating method including, mixing a conductive attachment into an insulating liquid, immersing an attachment target in the insulating liquid in which the attachment is mixed, and applying ultrasonic vibration to the insulating liquid in which the attachment target is immersed and causing friction between the attachment target and the attachment to charge the attachment target and the attachment.

9 Claims, 7 Drawing Sheets

| | Coating | Solvent | Ultrasonic wave application time | Leaving time | Ultrasonic frequency | Voltage application amount after stopping of ultrasonic waves | Attachment state |
|---|---|---|---|---|---|---|---|
| Example | Molybdenum trioxide | Insulating solvent Hydrocarbon solvent | 300sec | 60sec | Compound 45kHz 90kHz 135kHz | 0 | Acceptable |
| Comparative Example 1 | Boron nitride | Insulating solvent Hydrocarbon solvent | 300sec | 60sec | Compound 45kHz 90kHz 135kHz | 0 | Unacceptable |
| Comparative example 2 | Molybdenum trioxide | 86.4% ethanol | 300sec | 60sec | Compound 45kHz 90kHz 135kHz | 0 | Unacceptable |
| Comparative example 3 | Molybdenum trioxide | Insulating solvent Hydrocarbon solvent | 10sec | 60sec | Compound 45kHz 90kHz 135kHz | 0 | Thin |
| Comparative example 4 | Molybdenum trioxide | Insulating solvent Hydrocarbon solvent | 300sec | 0sec | Compound 45kHz 90kHz 135kHz | 0 | Unacceptable |
| Comparative example 5 | Molybdenum trioxide | Insulating solvent Hydrocarbon solvent | 300sec | 60sec | 45kHz | 0 | Uneven |
| Comparative example 6 | Molybdenum trioxide | Insulating solvent Hydrocarbon solvent | 300sec | 60sec | 170kHz | 0 | Uneven |
| Comparative example 7 | Molybdenum trioxide | Insulating solvent Hydrocarbon solvent | 300sec | 60sec | Compound 45kHz 90kHz 135kHz | −1000V | Thick |
| Comparative example 8 | Molybdenum trioxide | Insulating solvent Hydrocarbon solvent | 300sec | 60sec | Compound 45kHz 90kHz 135kHz | +1000V | Thin |

(56) References Cited

U.S. PATENT DOCUMENTS 3,614,069 A * 10/1971 Murry ..... B01F 11/0208 366/108
3,672,823 A * 6/1972 Boucher ..... A61L 2/025 134/1
3,749,559 A * 7/1973 Prasse ..... B23P 15/08 277/442
4,732,779 A * 3/1988 Towata ..... C04B 20/1055 156/166
5,225,089 A * 7/1993 Benes ..... B01D 21/283 210/188
5,523,058 A * 6/1996 Umemura ..... A61N 7/02 134/1
5,688,464 A * 11/1997 Jacobs ..... B29C 41/12 264/308
6,103,295 A * 8/2000 Chan ..... A61K 51/12 427/346
6,699,711 B1 * 3/2004 Hahn ..... C12N 13/00 241/2
9,005,686 B2 * 4/2015 Bates ..... A23L 1/0252 204/157.62
2002/0143321 A1 * 10/2002 Shibata ..... A61B 17/320068 606/1
2004/0022957 A1 * 2/2004 Thompson ..... C23C 18/1669 427/436
2009/0130339 A1 * 5/2009 Son, II ..... C23C 18/1666 427/601
2010/0039036 A1 * 2/2010 Zolezzi-Garreton ..... H05H 1/2475 315/111.21
2011/0281071 A1 * 11/2011 Vogel ..... B82Y 30/00 428/143
2015/0125758 A1 * 5/2015 Zhou ..... H01G 11/68 429/245
2018/0291305 A1 * 10/2018 Kumar Tompala ..... C10M 157/10

OTHER PUBLICATIONS

L.Hartshorn et al.; "Static Electricity in Dry-Cleaning Processes"; Journal of the Society of Chemical Industry, Transactions and Communications; vol. 57, T178-183; Jun. 1938.*

S.S. Mackeown et al.; "Electrical Charges Produced by Flowing Gasoline"; Industrial and Engineering Chemistry; vol. 34, No. 6, pp. 659-664; Jun. 1942.*

George Brewer; "The Relationship Between the Grain of textiles and the Frictional electricity Generated in Organic Solvent Systems"; The Journal of the American Oil Chemists' Society; pp. 218-219; Jun. 1952.*

R.J. Lewis, Sr.; Hawley's Condensed Chemical Dictionary, 12th edition; Van Nostrand Reinhold company, New York; 1993 (no month); excerpts pp. 649, 657, 671, 767, 787, 804-806 & 871.*

Richard J Lewis, Sr., editor; Hawley's Condensed Chemical Dictionary, 12th edition; Van Nostrand Reinhold company; New York; 1993 (no month); excerpt pp. 612-613.*

Jun. 27, 2017 Office Action issued in Japanese Application No. 2014-252915.

* cited by examiner

| | Coating | Solvent | Ultrasonic wave application time | Leaving time | Ultrasonic frequency | Voltage application amount after stopping of ultrasonic waves | Attachment state |
|---|---|---|---|---|---|---|---|
| Example | Molybdenum trioxide | Insulating solvent Hydrocarbon solvent | 300sec | 60sec | Compound 45kHz 90kHz 135kHz | 0 | Acceptable |
| Comparative Example 1 | Boron nitride | Insulating solvent Hydrocarbon solvent | 300sec | 60sec | Compound 45kHz 90kHz 135kHz | 0 | Unacceptable |
| Comparative example 2 | Molybdenum trioxide | 86.4% ethanol | 300sec | 60sec | Compound 45kHz 90kHz 135kHz | 0 | Unacceptable |
| Comparative example 3 | Molybdenum trioxide | Insulating solvent Hydrocarbon solvent | 10sec | 60sec | Compound 45kHz 90kHz 135kHz | 0 | Thin |
| Comparative example 4 | Molybdenum trioxide | Insulating solvent Hydrocarbon solvent | 300sec | 0sec | Compound 45kHz 90kHz 135kHz | 0 | Unacceptable |
| Comparative example 5 | Molybdenum trioxide | Insulating solvent Hydrocarbon solvent | 300sec | 60sec | 45kHz | 0 | Uneven |
| Comparative example 6 | Molybdenum trioxide | Insulating solvent Hydrocarbon solvent | 300sec | 60sec | 170kHz | 0 | Uneven |
| Comparative example 7 | Molybdenum trioxide | Insulating solvent Hydrocarbon solvent | 300sec | 60sec | Compound 45kHz 90kHz 135kHz | -1000V | Thick |
| Comparative example 8 | Molybdenum trioxide | Insulating solvent Hydrocarbon solvent | 300sec | 60sec | Compound 45kHz 90kHz 135kHz | +1000V | Thin |

FIG. 4

ATTACHMENT COATING METHOD

CROSS-REFERENCE TO RELATED APPLICATIONS

This application is based upon and claims the benefit of priority from Japanese Patent Application No. 2014-252915, filed Dec. 15, 2014, the entire contents of which are incorporated herein by reference.

BACKGROUND OF THE INVENTION

1. Field of the Invention

The present invention relates to an attachment coating method to coat a target with an attachment.

2. Description of the Related Art

Jpn. Pat. Appln. KOKAI Publication No. 1-111899 discloses a technique for applying ultrasonic vibration for stirring in a technique of electrodeposition coating. Jpn. Pat. Appln. KOKAI Publication No. 2001-151828 discloses a technique for maintaining a high electric resistivity of a carrier fluid for the purpose of maintaining toner charge stability in a technique for printing a circuit pattern by an electrophotographic developing method.

BRIEF SUMMARY OF THE INVENTION

An attachment coating method including, mixing a conductive attachment into an insulating liquid, immersing an attachment target in the insulating liquid in which the attachment is mixed, and applying ultrasonic vibration to the insulating liquid in which the attachment target is immersed and causing friction between the attachment target and the attachment to charge the attachment target and the attachment.

Advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 4 is a table showing conditions according to the Example of the present invention and Comparative Examples;

DETAILED DESCRIPTION OF THE INVENTION

[First Embodiment]

Figure 1:
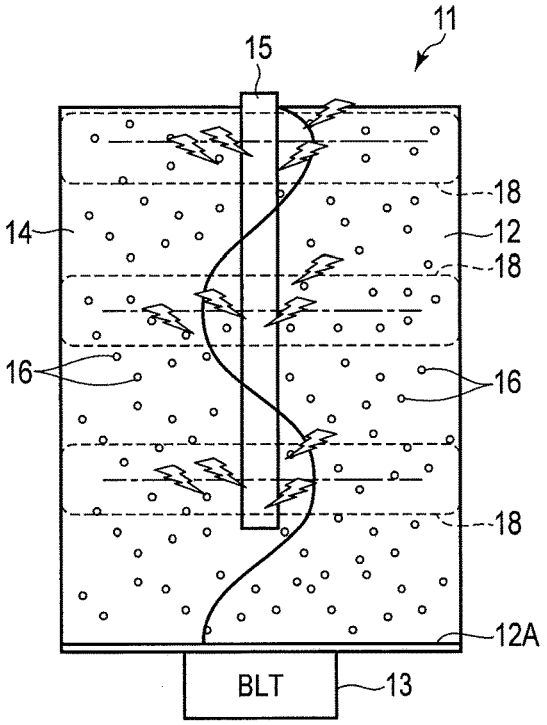
FIG. 1 is a front view schematically showing a step of applying ultrasonic vibration by an ultrasonic vibration generator for use in an attachment coating method according to an embodiment.
Figure 2:
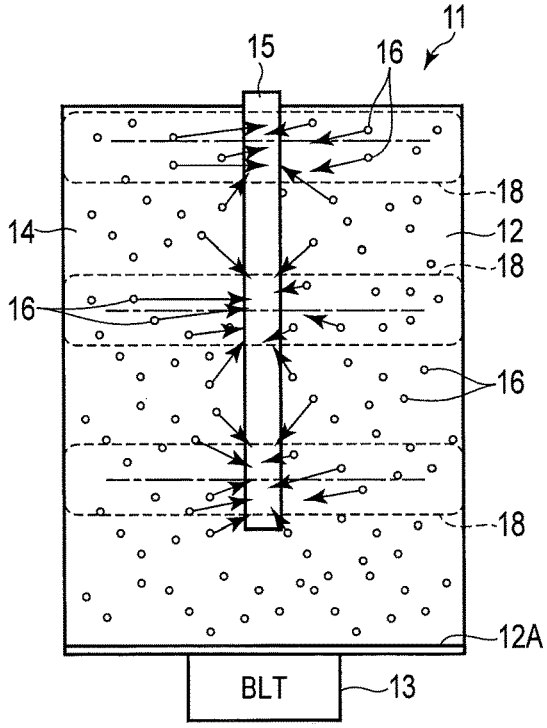
FIG. 2 is a front view schematically showing how the attachment is attached to an attachment target in a leaving process (step) by the ultrasonic vibration generator shown in FIG. 1.

An embodiment of an attachment coating method is described with reference to FIG. 1 to FIG. 3. In this embodiment, an attachment target undergoes the following steps and can be thereby uniformly coated with an attachment. A workpiece (attachment target) is coated with the attachment, for example, for the purpose of improving mold releasability when the workpiece is taken out of a mold.

An ultrasonic vibration generator 11 described below is used in the attachment coating method according to the embodiment. As shown in FIG. 1, the ultrasonic vibration generator 11 has a tank 12, a bolt-clamped Langevin type transducer (BLT) 13 provided on the bottom of the tank 12, and an electric power supply circuit which supplies electricity to the BLT 13. In the ultrasonic vibration generator 11, electricity is supplied to the BLT 13 from the electric power supply circuit, and ultrasonic vibration can be thereby applied to a liquid 14 retained in the tank 12 and to an attachment target 15 immersed in the liquid 14. The frequency of the ultrasonic vibration actually applied to the liquid 14 and the attachment target 15 is determined by, for example, the resonant frequency of the BLT 13 on the output side, the material of the attachment target 15, and the length of the attachment target 15. The frequency of the ultrasonic vibration actually applied to the liquid 14 and the attachment target 15 can be measured, for example, by putting a hydrophone into the liquid 14 retained in the tank 12 and measuring its sound pressure (voltage).

A method of coating with an attachment 16 according to the present embodiment is described. This coating method includes a first step of mixing the attachment 16 into the liquid 14, a second step of immersing the attachment target 15 in the liquid 14, and a third step of applying ultrasonic vibration to the liquid 14 in which the attachment target 15 is immersed.

In the first step, first, the liquid 14 is put into the tank 12 of the ultrasonic vibration generator 11. Molybdenum trioxide which is the attachment 16 is then mixed into the liquid 14. The molybdenum trioxide is conductive. The attachment 16 has only to be a conductive material, and may be any conductive material other than molybdenum trioxide. A conductive material other than molybdenum trioxide is, for example, molybdenum disulfide.

In the first step, the liquid 14 is stirred with, for example, a stirring rod so that the molybdenum trioxide may be uniform in the liquid 14. Alternatively, an operation switch of the ultrasonic vibration generator 11 may be turned on so that ultrasonic waves are applied to the liquid 14 in the tank 12 to stir the liquid 14 for mixing. An insulating lubricator (insulating lubricating oil) can be used as the liquid 14 to be put into the tank 12. For example, an isoparaffinic hydrocarbon solvent can be used as the insulating lubricator. By way of example, a brand name "Daphne Alpha Cleaner L" manufactured by Idemitsu Kosan Co., Ltd. can be used. The insulating lubricator is not limited to the isoparaffinic hydrocarbon solvent, and other kinds of lubricators such as a naphthenic hydrocarbon solvent can be used. One example of a naphthenic hydrocarbon solvent is a brand name "Daphne cleaner" manufactured by Idemitsu Kosan Co., Ltd. The volume resistivity of "Daphne Cleaner" is $1.9\times10^{13}$ Ω·m. In general, when the volume resistivity of a liquid is $10^8$ Ω·m or more, this liquid can be considered to have insulating properties.

In the second step, the attachment target 15 is immersed in the liquid in which the molybdenum trioxide is mixed as described above. The attachment target 15 is suspended with its top caught by support means, and can be thereby immersed in the liquid so that the attachment target 15 is floating from a bottom 12A of the tank 12 as shown in FIG. 1. The attachment target 15 is metallic, and is made of one of the materials selected from the group consisting of titanium, a titanium alloy, and a stainless alloy. The attachment target 15 has a shape of, for example, a round bar, but may have any shape such as a quadratic prism shape, a spherical shape, a conical shape, or a quadrangular pyramid shape.

In the third step, ultrasonic vibration is applied to the liquid 14 and the attachment target 15 by the ultrasonic vibration generator 11 for a predetermined length of time. If the operation switch of the ultrasonic vibration generator 11 is turned on, an electric current is supplied to the BLT 13 from the electric power supply circuit, and ultrasonic vibration is then generated from the BLT 13. The ultrasonic vibration is applied to the liquid 14 and the attachment target 15. As a result, the attachment target 15 is negatively charged, and the attachment 16 is positively charged.

Furthermore, after the ultrasonic vibration is applied to the liquid 14 and the attachment target 15 in the third step, it is preferable to leave the state as it is (perform a leaving step) for a predetermined length of time. This leaving procedure can accelerate the sticking of the attachment 16 to the attachment target 15. Specifically, the method of coating with the attachment 16 was conducted under conditions shown as Example in FIG. 4. The conditions according to the Example were compared with the conditions according to Comparative Examples 1 to 8 in FIG. 4 as below to confirm the effectiveness of the method of coating with the attachment 16 according to the present embodiment (Example).

Example

Figure 5:
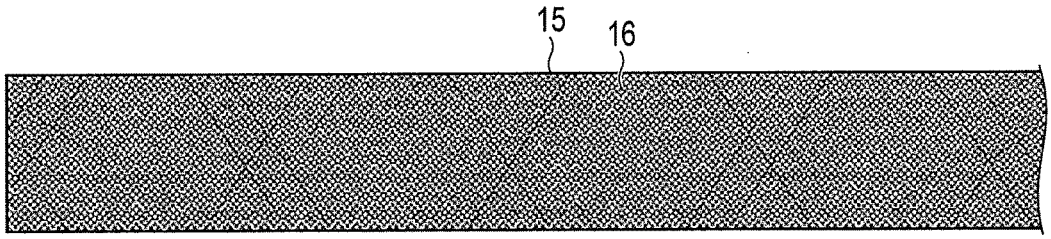
FIG. 5 is a side view showing the attachment target processed by the attachment coating method according to the Example.

In the Example, molybdenum trioxide was used as the attachment 16. An isoparaffinic hydrocarbon solvent which was an insulating solvent was used as the liquid 14. The application time of ultrasonic waves was 300 seconds. A leaving time after the application of the ultrasonic waves was 60 seconds. A compound frequency of 45 kHz, 90 kHz, and 135 kHz was used as the frequency of the ultrasonic waves applied to the liquid 14 and the attachment target 15. The first to third steps and the leaving procedure that have been described above were conducted under the conditions according to the Example, so that the attachment target 15 could be uniformly coated with the attachment 16 as in FIG. 5. In FIG. 5, the right end is the side supported by the support means, and the left end is located close to the bottom 12A of the tank 12. As in FIG. 5, the attachment state was judged to be acceptable when the amount of the attachment 16 attached to the attachment target 15 was uniform and the thickness of the attachment 16 was also sufficient.

Figure 6:
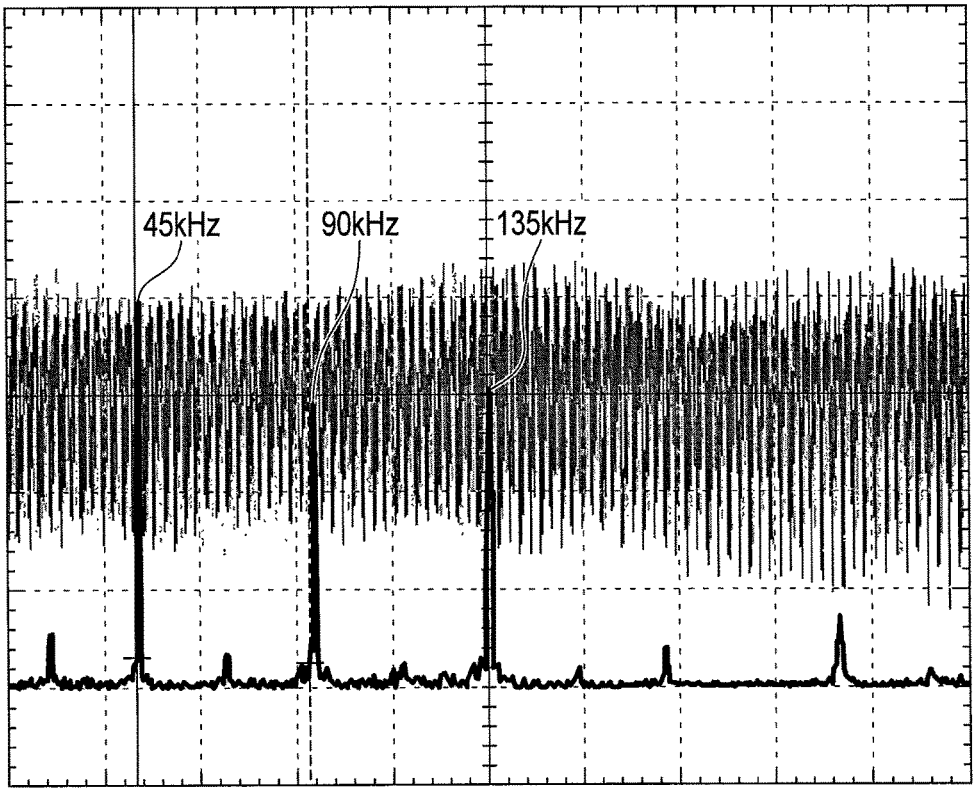
FIG. 6 is a graph showing the sound pressure of ultrasonic waves actually applied in a third step and frequencies obtained by FFT decomposition of the sound pressure in the attachment coating method according to the Example.

Furthermore, under the conditions according to the Example, the sound pressure of the ultrasonic waves applied to the liquid 14 and the attachment target 15 in the tank 12 of the ultrasonic vibration generator 11 was measured. The measurement results are shown in FIG. 6. In the graph of FIG. 6, the measured sound pressure of the ultrasonic waves is indicated by a thin line waveform. The amplitude of the waveform indicates the intensity of the sound pressure. When the sound pressure was further decomposed by fast Fourier transform (FFT), a frequency component of 45 kHz, a frequency component of 90 kHz, and a frequency component of 135 kHz were respectively detected. Each of the frequency components is indicated by a black line in FIG. 6. A vertical axis of the black line indicating each of the frequency components indicates the intensity of each of the frequency components. From FIG. 6, it can be found out that the respective frequency components of 45 kHz, 90 kHz, and 135 kHz are included at substantially equal ratios in the ultrasonic waves applied to the liquid 14 and the attachment target 15. The frequency component of 45 kHz is the first frequency component of fundamental waves, and the frequency components of 90 kHz and 135 kHz are the second frequency components (harmonic components) which are integral multiples of (two times and three times) the frequency of the fundamental waves.

In the Example, it is considered that the attachment target 15 and the attachment 16 are electrostatically charged as in a hypothesis described below. That is, if ultrasonic vibration (which is first ultrasonic waves) is applied to the liquid 14 and the attachment target 15, the attachment 16 actively moves, and the attachment target 15 also vibrates. Thus, the attachment 16 and the attachment target 15 are charged due to friction therebetween. The sound pressure is higher at antinode positions 18 of the ultrasonic vibration, so that the movement of the attachment 16 and the vibration of the attachment target 15 are stronger in the vicinity of the antinode positions 18 as indicated in FIG. 1 and a sine curve corresponding to the first ultrasonic waves in FIG. 1. As a result, as shown in FIG. 2, the attachment 16 which has been charged in the vicinity of the antinode positions 18 is attracted and attached to the vicinity of the antinode positions 18 of the attachment target 15 which is also strongly charged. It is considered that the attachment 16 is attached to the attachment target 15 in accordance with such a principle (hypothesis).

Figure 3:
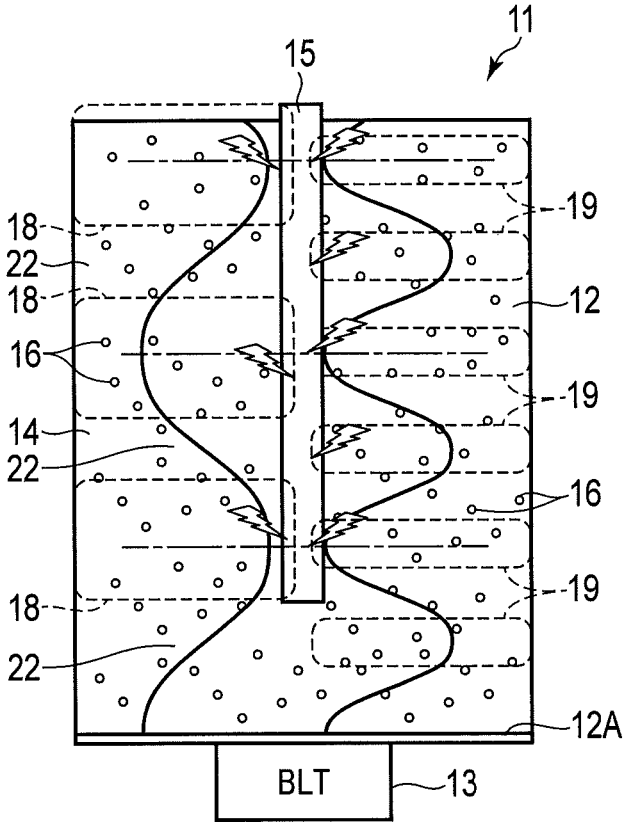
FIG. 3 is a front view schematically showing how the attachment is attached to the attachment target in the leaving process (step) by the ultrasonic vibration generator shown in FIG. 1.

In contrast, as shown in FIG. 3, if ultrasonic waves (which are second ultrasonic waves) that are twice as high in frequency as, for example, the first ultrasonic waves are simultaneously input, antinode positions 19 of the ultrasonic vibration of the second ultrasonic waves can be located in parts corresponding to node positions 22 of the first ultrasonic vibration as indicated in FIG. 3 and sine curves corresponding to the second ultrasonic waves in FIG. 3. Thus, the attachment target 15 can be more evenly and more uniformly coated with the attachment 16 than in the example shown in FIG. 1.

In the Example, the ultrasonic waves of the fundamental frequency (45 kHz), the ultrasonic waves of the frequency (90 kHz) which is twice as high as the fundamental frequency, and the ultrasonic waves of the frequency (135 kHz) which is three times as high as the fundamental frequency are simultaneously input, so that the attachment 16 can be uniformly attached to the attachment target 15 as shown in FIG. 5.

Comparative Example 1

Figure 7:
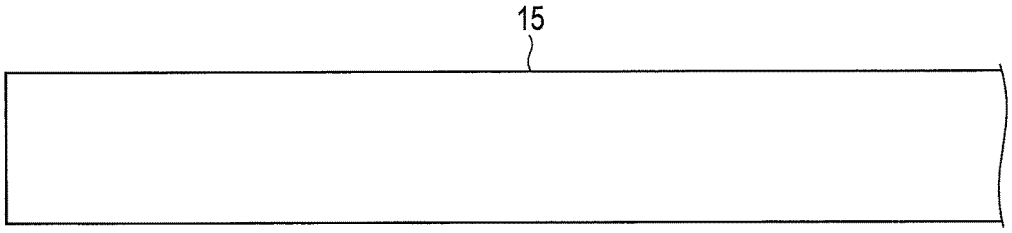
FIG. 7 is a side view showing the attachment target processed by an attachment coating method according to Comparative Example 1.

In Comparative Example 1, boron nitride which is an insulator was used as the attachment 16. In other respects, the first to third steps and the leaving procedure were conducted under exactly the same conditions as those according to the Example. As a result, the attachment 16 was not at all attached to the attachment target 15 as shown in FIG. 7. Thus, the attachment state was judged to be unacceptable. In Comparative Example 1, boron nitride was not charged, so that the attachment 16 was not attached to the attachment target 15.

Comparative Example 2

In Comparative Example 2, ethanol of 86.4 volume percent concentration was used as the liquid 14 into which the attachment 16 was mixed. Ethanol of 86.4 volume percent concentration is a conductor. In other respects, the first to third steps and the leaving procedure were conducted under exactly the same conditions as those according to the Example. As a result, the attachment 16 was not at all attached to the attachment target 15 as in FIG. 7. Thus, the attachment state was judged to be unacceptable. In Comparative Example 2, it was considered that the attachment 16 was not successfully charged because the charging of the attachment 16 diffused to the surrounding conductive liquid 14 (ethanol).

Comparative Example 3

Figure 8:
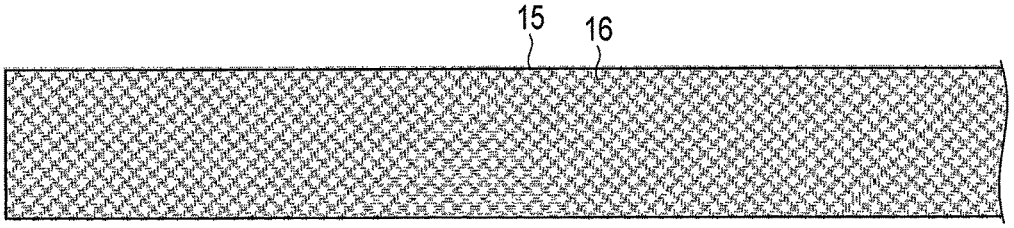
FIG. 8 is a side view showing the attachment target processed by an attachment coating method according to Comparative Example 3.

In Comparative Example 3, the time of the application of ultrasonic waves in the third step was 10 seconds. In other respects, the first to third steps and the leaving procedure were conducted under exactly the same conditions as those according to the Example. As a result, the attachment 16 was thinly attached to the attachment target 15 as shown in FIG. 8. The amount of the attachment 16 attached to the attachment target 15 in Comparative Example 3 was apparently smaller than that in the Example. Thus, the attachment state was judged to be thin. In Comparative Example 3, it could be considered that the attachment 16 and the vibration of the attachment target 15 were insufficiently charged because the time of the application of ultrasonic waves was too short in the third step.

Comparative Example 4

In Comparative Example 4, the leaving procedure was not conducted after the application of ultrasonic waves in the third step, and the attachment target 15 was pulled out of the conductive liquid 14 immediately after the completion of the application of ultrasonic waves. In other respects, the first to third steps were conducted under exactly the same conditions as those according to the Example. As a result, the attachment 16 was not at all attached to the attachment target 15 as in FIG. 7. Thus, the attachment state was judged to be unacceptable. In Comparative Example 4, it was considered that there was not enough time for the attachment 16 to be attracted and attached to the attachment target 15 after the attachment 16 and the attachment target 15 had been charged because the leaving procedure was not conducted. Therefore, it was considered that the attachment 16 was not successfully attached.

Comparative Example 5

Figure 9:
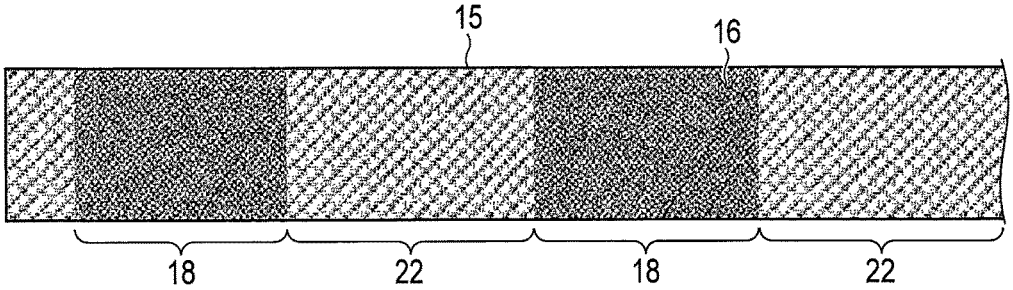
FIG. 9 is a side view showing the attachment target processed by an attachment coating method according to Comparative Example 5.

In Comparative Example 5, the frequency of the ultrasonic waves applied to the liquid 14 and the attachment target 15 is only the fundamental frequency (45 kHz). In other respects, the first to third steps and the leaving procedure were conducted under exactly the same conditions as those according to the Example. As a result, the attachment target 15 was coated with the attachment 16 so that thickly attached parts and thinly attached parts alternate as shown in FIG. 9. Thus, the attachment state was judged to be uneven.

Figure 10:
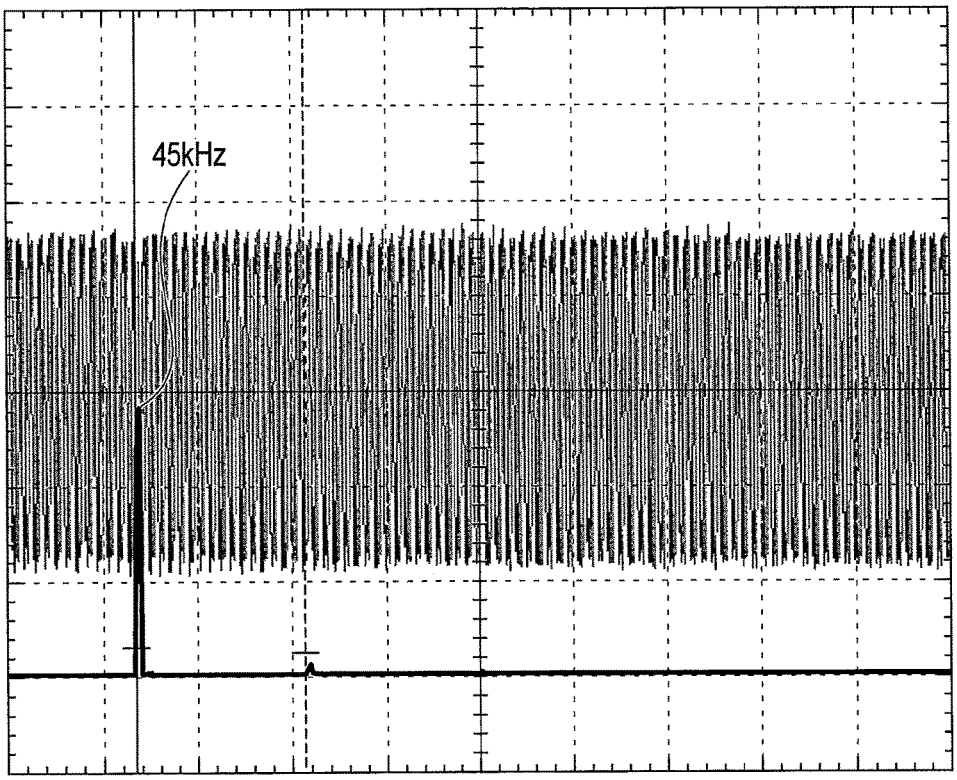
FIG. 10 is a graph showing the sound pressure of ultrasonic waves actually applied in the third step and frequencies obtained by FFT decomposition of the sound pressure in the attachment coating method according to Comparative Example 5.

Under the conditions according to Comparative Example 5, the sound pressure of the ultrasonic waves actually applied to the liquid 14 and the attachment target 15 in the tank 12 was measured by a hydrophone. In the graph of FIG. 10, the sound pressure of the ultrasonic waves is indicated by a thin line waveform. The amplitude of the waveform indicates the intensity (voltage) of the sound pressure. When the sound pressure was decomposed by fast Fourier transform (FFT), a frequency component of 45 kHz was detected. The frequency component of 45 kHz is indicated by a black line in FIG. 10. Thus, it was found out that the ultrasonic waves of the fundamental frequency (45 kHz) were only input in Comparative Example 5.

In Comparative Example 5, the frequency of the ultrasonic waves to be input was only the fundamental frequency (45 kHz), and it was therefore considered that charging was insufficient at the node positions 22 of the ultrasonic vibration so that the coating amount of the attachment 16 was smaller at the node positions 22 as shown in FIG. 9.

Comparative Example 6

Figure 11:
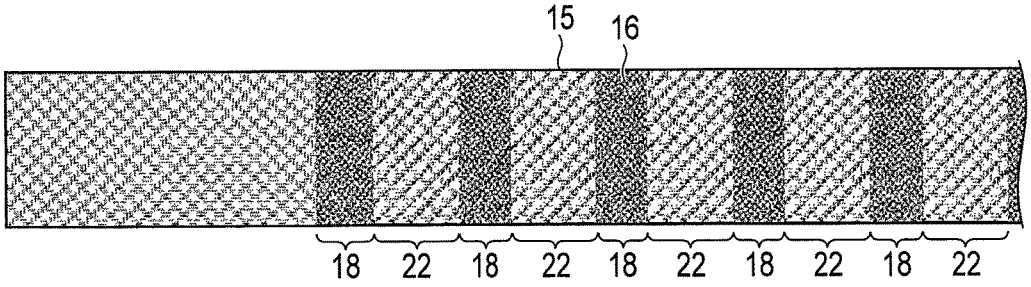
FIG. 11 is a side view showing the attachment target processed by an attachment coating method according to Comparative Example 6.

In Comparative Example 6, the frequency of the ultrasonic waves applied to the liquid 14 and the attachment target 15 is only a frequency (170 kHz) different from the fundamental frequency. In other respects, the first to third steps and the leaving procedure were conducted under exactly the same conditions as those according to the Example. As a result, the attachment target 15 was coated with the attachment 16 so that thickly attached parts and thinly attached parts alternate as shown in FIG. 11. The intervals of the thickly attached part and the thinly attached part were smaller than the pitch according to Comparative Example 5 in FIG. 9. Thus, the attachment state according to Comparative Example 6 was judged to be uneven.

In Comparative Example 6, the frequency of the ultrasonic waves to be input was only the frequency of 170 kHz, and it was therefore considered that charging was insufficient at the node positions 22 of the ultrasonic vibration so that the coating amount of the attachment 16 was smaller at the node positions 22 as shown in FIG. 11.

However, it was considered that in Comparative, Example 6, the frequency was higher than in Comparative Example 5, and the intervals of the antinode position 18 and the node position 22 were therefore smaller, so that the thick parts and thin parts alternate at a smaller pitch.

Comparative Example 7

Figure 12:
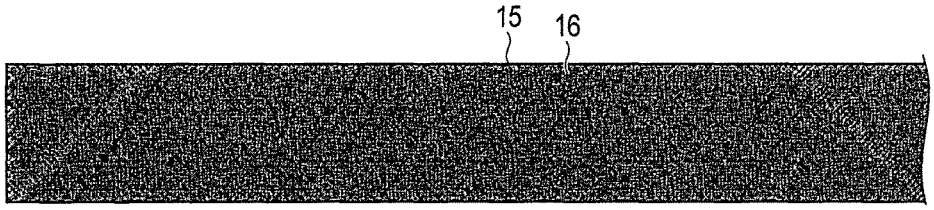
FIG. 12 is a side view showing the attachment target processed by an attachment coating method according to Comparative Example 7.

In Comparative Example 7, the first to third steps were conducted under the same conditions as those according to the Example. After the end of the third step, the leaving procedure was conducted such that a voltage of −1000 V was left applied to the attachment target 15 for 60 seconds. As a result, as shown in FIG. 12, the attachment 16 was thickly attached to the surface of the attachment target 15. The attachment amount of the attachment 16 according to Comparative Example 7 was greater than the attachment amount according to the Example. Thus, the attachment state of the attachment 16 was judged to be thick.

Comparative Example 8

In Comparative Example 8, the first to third steps were conducted under the same conditions as those according to the Example. After the end of the third step, the leaving procedure was conducted such that a voltage of +1000 V was left applied to the attachment target 15 for 60 seconds. As a result, as in FIG. 8, the attachment 16 was thinly attached to the surface of the attachment target 15.

From the results according to Comparative Examples 7 and 8, the attachment amount of the attachment 16 increased if the negative voltage was applied to the attachment target 15 after the input of ultrasonic waves in the third step, whereas the attachment amount of the attachment 16 decreased if the positive voltage was applied to the attachment target 15 after the input of ultrasonic waves in the third step. These results proved that there was a phenomenon in which by the input of ultrasonic waves, the attachment 16 was positively charged and the attachment target 15 was negatively charged at the same time. Thus, it is understood that the hypothesis described above is substantially correct.

According to the present embodiment and the Example, the method of coating with the attachment 16 includes the steps of mixing the conductive attachment 16 into the insulating liquid 14, immersing the attachment target 15 in the insulating liquid 14 in which the attachment 16 is mixed, and applying ultrasonic vibration to the insulating liquid 14 in which the attachment target 15 is immersed and causing friction between the attachment target 15 and the attachment 16 to charge the attachment target 15 and the attachment 16.

According to this configuration, by a simple method of applying ultrasonic vibration, the attachment target 15 and the attachment 16 can be charged, and the attachment 16 can be uniformly attached to the attachment target 15. Thus, the coating step can be simplified, and the quality of the attachment target 15 coated with the attachment 16 can be improved.

The attachment coating method includes the step of leaving for a predetermined length of time after the step of charging. According to this configuration, the attachment target 15 can be surely coated with the attachment 16, and the quality of the attachment target 15 coated with the attachment 16 can be improved.

In this case, the ultrasonic vibration includes a first frequency component having the frequency of fundamental waves, and second frequency components having frequencies which are integral multiples of the frequency of the fundamental waves and which are different from each other. According to this configuration, the antinode positions of the second ultrasonic waves can be located at the node positions of the ultrasonic vibration of the fundamental waves. Thus, the attachment target 15 can be uniformly coated with the attachment 16, and the quality of the attachment target 15 coated with the attachment 16 can be further improved.

The present invention is not limited to the embodiment described above, and modifications can be suitably made without departing from the spirit thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method comprising:

mixing, in a tank, molybdenum trioxide into an isoparaffinic hydrocarbon solvent;

immersing a metal attachment target in the isoparaffinic hydrocarbon solvent in which the molybdenum trioxide is mixed, in a state in which the metal attachment target is secured by its top and suspended a distance above a bottom of the tank;

applying ultrasonic vibration, from the bottom of the tank, in a single direction to the isoparaffinic hydrocarbon solvent in which the metal attachment target is immersed and causing friction between the metal attachment target and the molybdenum trioxide to electrostatically charge the metal attachment target and the molybdenum trioxide, the ultrasonic vibration comprising a first frequency component having a frequency of fundamental waves, and second frequency components having frequencies that are different from each other and that are integral multiples of the frequency of the fundamental waves; and leaving the metal attachment target in the isoparaffinic hydrocarbon solvent for a predetermined length of time after applying the ultrasonic vibration so as to coat the metal attachment target with the molybdenum trioxide.

2. The method according to claim 1, wherein the isoparaffinic hydrocarbon solvent has a volume resistivity of $10^8$ Ω·m or more.

3. The method according to claim 1, wherein the ultrasonic vibration is applied for 300 seconds, and the metal attachment target is left in the isoparaffinic hydrocarbon solvent for 60 seconds.

4. The method according to claim 1, wherein one of the second frequency components has a frequency that is twice as high as the frequency of the fundamental waves.

5. The method according to claim 4, wherein another one of the second frequency components has a frequency that is three times as high as the frequency of the fundamental waves.

6. The method according to claim 1, wherein the metal attachment target is made from a material selected from the group consisting of titanium, a titanium alloy, and a stainless alloy.

7. The method according to claim 1, wherein an antinode position of one of the second frequency components is located at a node position of the first frequency component.

8. The method according to claim 1, wherein in the step of applying the ultrasonic vibration, the metal attachment target is negatively charged and the molybdenum trioxide is positively charged.

9. The method according to claim 1, wherein the first frequency component has a frequency of 45 kHz, and the second frequency components have frequencies of 90 kHz and 135 kHz.

* * * * *